US007146827B2

(12) United States Patent
Mardkha

(10) Patent No.: US 7,146,827 B2
(45) Date of Patent: Dec. 12, 2006

(54) MIXED CUT GEMSTONE

(75) Inventor: Joseph Mardkha, Great Neck, NY (US)

(73) Assignee: Diamond Innovations, LLC, Great Neck, NY (US)

( * ) Notice: Subject to any disclaimer, the term of this patent is extended or adjusted under 35 U.S.C. 154(b) by 0 days.

(21) Appl. No.: 09/949,684

(22) Filed: Sep. 10, 2001

(65) Prior Publication Data

US 2002/0170315 A1 Nov. 21, 2002

Related U.S. Application Data

(60) Provisional application No. 60/292,243, filed on May 18, 2001.

(51) Int. Cl.
*A44C 17/00* (2006.01)

(52) U.S. Cl. ..... 63/32; D11/89; D11/90

(58) Field of Classification Search ..... 63/32; D11/89, 90

See application file for complete search history.

(56) References Cited

U.S. PATENT DOCUMENTS

| | | | | | |
|---|---|---|---|---|---|
| 59,299 | A | * | 10/1866 | Steel | 15/153 |
| 138,314 | A | | 4/1873 | Bruhl | |
| 1,291,506 | A | * | 1/1919 | Heller | 63/32 |
| 2,265,316 | A | * | 12/1941 | Schenck | 63/32 |
| 3,490,250 | A | * | 1/1970 | Jones | 63/32 |
| 3,527,198 | A | | 9/1970 | Takaoka | 125/30 |
| 3,665,729 | A | | 5/1972 | Elbe | 63/32 |
| 3,788,097 | A | | 1/1974 | Elbe | 63/32 |
| 3,796,065 | A | | 3/1974 | Watermeyer | 63/32 |
| 3,875,760 | A | | 4/1975 | Jones | 63/32 |
| D242,643 | S | | 12/1976 | Saltzman | D11/90 |
| D244,367 | S | * | 5/1977 | Saltzman | D11/90 |
| 4,020,649 | A | | 5/1977 | Grossbard | 63/32 |
| 4,118,950 | A | | 10/1978 | Grossbard | 63/32 |
| 4,306,427 | A | | 12/1981 | Urban | 63/32 |
| 4,555,916 | A | | 12/1985 | Grossbard | 63/32 |
| 4,708,001 | A | | 11/1987 | Alburger | 63/32 |
| D297,718 | S | | 9/1988 | Cohen et al. | D11/90 |

(Continued)

FOREIGN PATENT DOCUMENTS

| | | |
|---|---|---|
| EP | 0016885 | 10/1980 |

(Continued)

OTHER PUBLICATIONS

Clark, "Gem Cutting Term" International Gem Society, May 30, 2000 or earlier, 2 pages + 1 page date documentation.*

(Continued)

*Primary Examiner*—Katherine Mitchell
(74) *Attorney, Agent, or Firm*—Lackenbach Siegel LLP

(57) ABSTRACT

A mixed cut gemstone comprising a girdle, a crown above the girdle and a pavilion below the girdle. The crown has a girdle break, a table break and a table. The table break is cut with triangular shaped facets and the girdle break is cut with triangular and quadrilaterally shaped facets. The present invention also describes a pavilion having a width and a length formed by two pairs of opposing pavilion sides and four pavilion corners. The pavilion is composed of four steps including: a first step descending from said girdle to a first step facet junction, a second step descending from said first step facet junction to a second step facet junction, a third step descending from said second step facet junction to a third step facet junction, and a fourth step descending from said third step facet junction to said culet. This mixed cut gemstone enables the appreciation of the desirable characteristics of a diamond in ways that prior art cuts do not allow.

55 Claims, 6 Drawing Sheets

U.S. PATENT DOCUMENTS

| | | | | | |
|---|---|---|---|---|---|
| 5,072,549 | A | * | 12/1991 | Johnston | 451/41 |
| 5,186,024 | A | | 2/1993 | Waters, Jr. | 63/32 |
| 5,190,024 | A | | 3/1993 | Senanayake | 125/30.01 |
| D340,670 | S | * | 10/1993 | Schachter | D11/90 |
| 5,293,858 | A | | 3/1994 | Peters | 125/30.01 |
| 5,454,235 | A | | 10/1995 | Freiesleben | 63/32 |
| D365,780 | S | | 1/1996 | Kaplan | D11/90 |
| 5,623,916 | A | | 4/1997 | El-Gaouni | 125/12 |
| D382,225 | S | | 8/1997 | Yuan | D11/90 |
| D382,506 | S | | 8/1997 | Cohen | D11/90 |
| 5,657,647 | A | | 8/1997 | Freiesleben | 63/32 |
| D384,592 | S | | 10/1997 | Simon-Tov et al. | D11/90 |
| D391,518 | S | * | 3/1998 | Slowinski et al. | D11/90 |
| 5,732,690 | A | | 3/1998 | Ogyu | 125/30.01 |
| D398,552 | S | | 9/1998 | Simon-Tov et al. | D11/90 |
| D400,818 | S | | 11/1998 | Rams | D11/90 |
| D411,479 | S | | 6/1999 | Yerushalmi et al. | D11/90 |
| D414,133 | S | | 9/1999 | Parker | D11/90 |
| 5,970,744 | A | | 10/1999 | Greeff | 63/32 |
| 6,006,548 | A | | 12/1999 | Freilich | 63/32 |
| D429,475 | S | * | 8/2000 | Steinberg | D11/90 |
| D439,542 | S | * | 3/2001 | Turner et al. | D11/90 |
| D442,114 | S | | 5/2001 | Greeff | D11/90 |
| D446,152 | S | * | 8/2001 | Kejejian | D11/90 |
| D457,831 | S | * | 5/2002 | Kaufman | D11/90 |
| D459,269 | S | * | 6/2002 | Libovich et al. | D11/90 |
| 6,449,985 | B1 | * | 9/2002 | Kejejian | 63/32 |
| D467,833 | S | * | 12/2002 | Mardkha | D11/90 |

FOREIGN PATENT DOCUMENTS

| | | |
|---|---|---|
| EP | 1013190 | 6/2000 |

OTHER PUBLICATIONS

Undated advertising showing Princess, Escada, Lucida, Eternal and Ashoka Cut Gemstones (p. 187).

Showing Lucida, Eternal and Escada Cut Gemstones. Modbee.com (website). The Wedding Guide: Special report, "*Wedding Jewelery Often An Heirloom*". The Associated Press, Jan. 21, 2001, 2pps.

*Gemstones of the World* by Walter Schumann, p. 80. Showing Prince Cut Gemstone.

*How to Choose a Fancy Shaped Diamond*—Diamond Shape at Blue Nile (Website), 3pps.

*Princess Cut*—Accredited Gem Appraisers. Gemappraisers.com (website), 2pps, revised Jan. 1999.

John Mawe, "*Treatise on Diamonds and Precious Stones-The Best Methods of Cutting and Polishing Them*", Second Edition, Longman, Hurst, Bees. Orme, and Brown, 1815.

Gemological Institute of America, "*The GIA: Diamond, The Edition*", 1993.

* cited by examiner

MIXED CUT GEMSTONE

The applicant wishes to claim priority from Provisional Application Filling No. 60/292,243 filed in the USPTO on May 18, 2001.

BACKGROUND OF THE INVENTION

The present invention pertains to gemstones and, more particularly, to a unique cut design for a diamond featuring controlled brilliance and dispersion that is immediately and recognizably different from cut designs currently known in the art in that it allows a viewer to readily perceive and appreciate the depth of the diamond material.

Diamond is an extremely hard substance that is created over millions of years in the depths of the earth under extremely harsh conditions. Extremely rare and difficult to secure, diamonds are desirable to consumers because of the unique and attractive distinguishing properties of cut stones including: brilliance, dispersion and scintillation. This combination of optical properties is unique to diamond material and is maximized when a diamond is well cut. The facet arrangement of a cut is essential to controlling the interaction of light that is necessary to display a diamond's beauty.

Brilliance refers to the amount of light passing through the table of the stone that is reflected back to the viewer by facet reflection. Light enters the diamond through the crown, hits one pavilion side, bounces to the opposite pavilion side and then is reflected back through the crown to the viewer. All facets must support the critical angle, optimally 24.5°, in order to achieve this light interaction. Failure to work around the critical angle in the design of the stone will cause light entering the crown to exit the diamond through the pavilion, instead of reflecting through the crown, resulting in a dark and dull stone.

Dispersion, also known as fire, is a measure of the degree to which white light entering the crown of the stone is broken up into spectral colors and returned back to the viewer through the crown. Dispersion is based on the refractive index, a measure of the degree to which light bends as it passes from the air to the stone. Diamond has one of the highest refractive indices for natural, transparent gemstones. Dispersion is influenced by the facet angles which control the manner in which light enters and exits the diamond, the number of internal facets in the stone design and the number of times that light rays spread across the facet junctions of the diamond. These factors directly affect the fire produced by a finished diamond and thus dispersion is also affected by the manner in which a diamond is cut and the angles employed in that cut.

Scintillation, often equated with the sparkle of a diamond, is an indication of the different light patterns obtained when the position of the stone or the observer is moved under light. The best examples of scintillating diamonds are found in round brilliant cuts. They display an eight-pointed star, radiating from the culet of the diamond when viewed from the table. Optimal scintillation displays a pleasing, even pattern of white flashes that results from proper facet symmetry.

Cut, including the facet arrangement, is the human contribution to a diamond's beauty and has important effects on the qualities of brilliance, scintillation and dispersion. Proportions are the key to the attractiveness of the cut. The relationships between the sizes and angles of the various parts and facets must successfully combine the display of brilliance, sparkle and fire—the most important elements of a diamond's visual appeal. Modern diamond cuts are the result of hundreds of years of study and experimentation of how to best display these unique and prized diamond qualities. It is desirable to create new and recognizable cuts of diamond for the discerning diamond buyer as a diamond must stand out as a stylish alternative to the traditional diamond cuts in order to attract the buyer. As a result, several cuts that most effectively optimize desirable diamond qualities of brilliance, dispersion and scintillation have become industry standards. Traditional gemstone cuts may be classified into three general categories: the brilliant cut, the step cut, and the hybrid or mixed cut.

The brilliant cut is traditionally used to create a round cut stone. This cut attempts to achieve maximum brilliancy and dispersion. The brilliant cut crown employs triangular facet patterns that radiate from a large central table facet towards the girdle edge. The pavilion mains radiate from the culet towards the girdle. The numerous facets employed produces maximum brilliance, forcing all light that enters the crown to be refracted and reflected from the pavilion facets back through the crown. Thus, the brilliant cut maximizes the fire of a diamond producing a highly recognizable and marketable stone. Many variations of brilliant cut stones exist in the art.

Step cut is a term of art used to define a rectangular shaped gemstone. Step cut is defined in the *The GIA Diamond Dictionary*, third edition, 1993, as a cutting style in which long, narrow, four-sided facets are arranged in rows parallel to the girdle on both the crown and the pavilion. There are usually three rows, although this may vary. Emerald cuts and baguettes are examples of step-cut designs.

The step cut is a rectangular or square shaped cut. The step cut crown is formed of three concentric rows of trapezoidal facets cut parallel to the girdle and radiating out from an octagonally shaped table facet having beveled corners. The step cut pavilion has two pairs of opposing pavilion sides and four pavilion corners. The pavilion further has three concentric rows or steps between the girdle and the culet, each step consisting of eight trapezoidal facets cut parallel to the girdle.

The step cut pavilion of the present invention has two pairs of opposing pavilion sides and four pavilion corners. The step cut pavilion of the present invention further has one or more steps consisting of eight facets comprising trapezoidal facets cut parallel to the girdle, which form the rectangular or square pavilion shape, and triangular facets, which form the pavilion corners. The step immediately adjacent to the girdle has triangular facets, which add brilliance to the pavilion when viewed through the crown.

Hybrid or mixed cuts employ a combination of brilliant and step facets, attempting to achieve the classic look of a step cut stone with brilliance and dispersion nearer to that of a brilliant cut stone. Traditional mixed cut gemstones employ a step cut crown combined with a brilliant cut pavilion.

The commercial utility for creative and new diamond cuts has led to the modern cuts such as the highly reflective Princess cut, with its mix of brilliant and step cut facts, the Escada cut, with a star-shaped reflection, the Lucida, with its 50 brightly reflective facets, the Eternal cut with 80 reflective facets and the Ashoka. Most modern cut designs focus on achieving maximum brilliance and dispersion in order to achieve market distinction.

However, these preparations of diamonds while attempting to spread maximum brilliance and fire fail to emphasize the qualities of depth, hardness, and clarity also unique to diamond material. "The name diamond refers to its hardness (Greek—adamas, the unconquerable). There is nothing comparable to it in hardness; it is therefore nearly imperishable." Schumann, Walter, *Gemstones of the World*, Sterling Publishing Co., Inc. New York. While it is not desirable to create a stone that completely lacks brilliance; as such a stone resembles a piece of glass and gives no hint as to the special nature of a diamond, no cut in the art achieves a balance between the display of qualities of brilliance, dispersion and fire and the qualities of depth, hardness and clarity. The facet arrangement of the present invention achieves a controlled balance between the optical properties of brilliance, dispersion and scintillation so that one property does not overpower the others thereby providing a controlled brilliance while also providing a view deep into the stone and promoting a sense of the hardness and clarity of the diamond material. The instant invention discloses a new coherent design that takes into consideration optical qualities and critical angles in order to create a unique and valuable stone.

DRAWINGS

There are attached four (4) sheets of drawings.

Figure 7A:
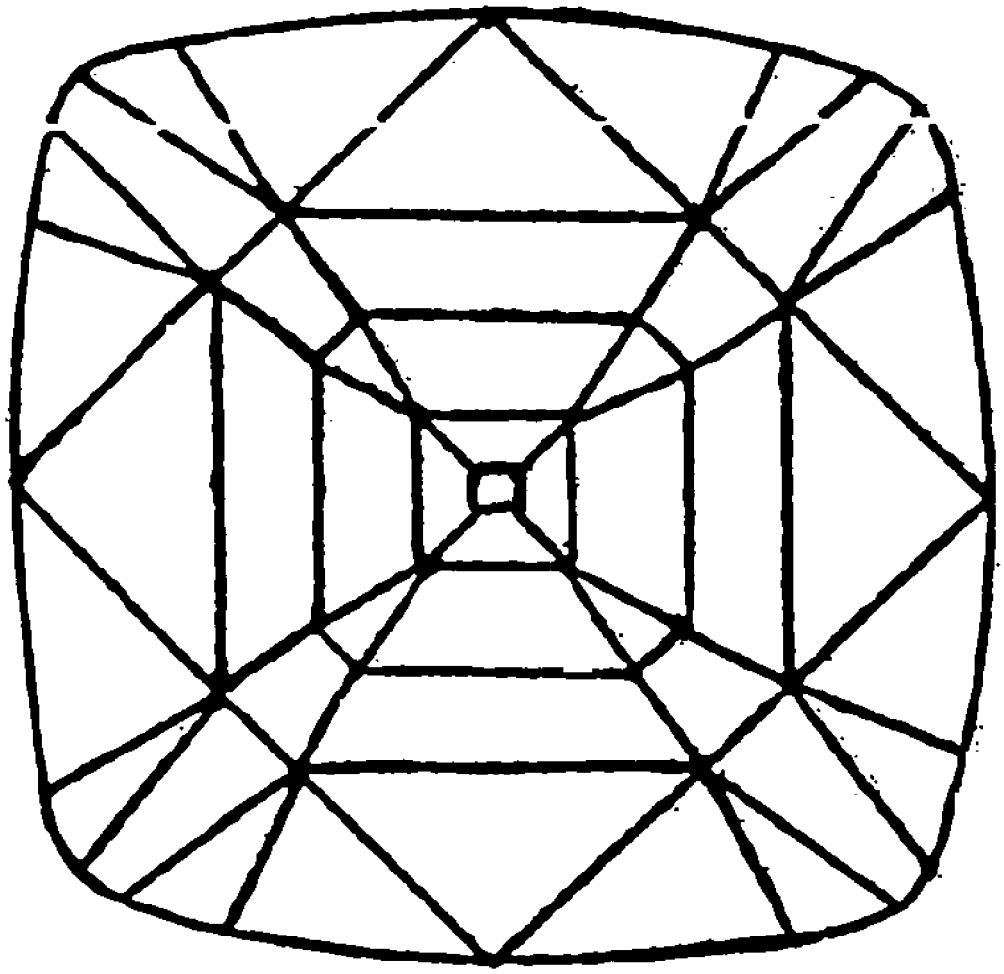

FIG. 7*a* is a cross sectional view of the pavilion of an alternate embodiment of the claimed invention, having a square culet, as it appears when severed from the crown at the girdle plane.

Figure 8:
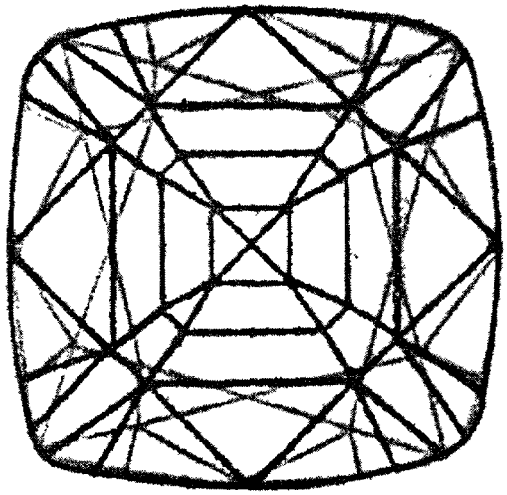

FIG. 8 is a top plan view of the claimed invention.

BRIEF SUMMARY OF THE INVENTION

Because of the prismatic nature of diamonds, cuts are usually quite standard; employing formulaic angles intended to achieve maximum spectral brilliance. The present invention does not seek to achieve maximum brilliance nor does it seek to produce a total lack of brilliance, which would result in a glass-like, lack-luster stone. Instead, the present invention seeks to achieve a balance between brilliance, that produces a lively stone, and depth, which requires an open view into the stone. Controlled and limited brilliance allows the viewer to see the facet arrangement of the pavilion steps easily. Thus the present invention describes a new diamond cut that displays a controlled and limited brilliance that highlights the additional qualities of depth, hardness and clarity that make the diamond an exceptional and desired stone.

The present invention is a mixed cut that successfully combines a brilliant cut crown and a modified step cut pavilion. Mixed cut diamonds are not new in the art, however the present combination of a square or rectangular brilliant cut crown with a modified four-stepped pavilion is unique in the art. The product of this new hybrid cut is a lively stone whose brilliance is sufficiently controlled so as to allow a view of the internal facet structure by creating a window through which the deep part of the diamond may be viewed. Unobstructed viewing of the pavilion facets of a diamond is not possible with traditional brilliant cuts because the view of the pavilion is obscured by light reflected by the maximized brilliance of the crown facets. The crown angles of the present invention function to localize and control brilliance so that a viewer may look past the refracted light to gain an unobstructed view into the stone thus enabling a view of the pavilion facets. By controlling the amount and location of brilliance, the viewer is able to see the facet arrangement of the succeeding step cut pavilion. An unobstructed view of the pavilion facets that create the architecture of the stone conveys a sense of the depth and hardness of the diamond. Thus, the cut of the present invention enhances and makes clear to the viewer the hardness and clarity that define flawlessness of the diamond itself.

The proportions of a cut diamond and the relationship between the sizes of various parts and angles are critical to creating the overall beauty of a finished diamond because they determine the extent to which a cut diamond achieves its optical potential. This new diamond cut combination produces a deeper diamond with a controlled and limited brilliance. The table frames the view into the geometric design of the pavilion thus pronouncing the depth of the stone. The lacy crown facet arrangement disperses light to create a lively stone that maintains the optical properties of brilliance dispersion and scintillation. Several modifications to the conventional brilliant crown and step cut pavilion were made in order to successfully combine these unlike cuts and to create a cohesive stone that achieves the above described optical result.

The reflection and dispersion of the conventional brilliant cut crown have been modified in the present invention by the use of a shallow crown angle in conjunction with a large table, thereby controlling the location and amount of light reflected from the crown. By controlling the location and amount of reflected light, the viewer's attention is drawn into the gemstone, providing a sense of the diamond's depth, hardness and clarity.

Conventional step cut pavilions comprise three pavilion steps, the facets of which meet at angular corners. The present invention employs four pavilion steps that stretch from girdle to culet and rounded pavilion corners. The present invention further employs unusually high lower girdle facet angles on the first pavilion step that work with the critical angle of the stone. These angles are cut at between 55° and 60° relative to the girdle, a delicate cut that is not typically employed in a step cut pavilion. The four pavilion steps are worked into the design while still working within the critical angle of the stone and maintaining the optical properties of brilliance, dispersion and scintillation. A significant and emphasized pavilion depth percentage of 45%–47% is also employed in this cut.

The conventional step cut pavilion has been further modified by the addition of sixteen triangular lower girdle facets to the first step of the pavilion. Each side and corner of the first pavilion step is divided into three triangular facets. These steeply cut triangular lower girdle facets function to successfully combine the step cut pavilion and brilliant crown into a cohesive stone that obeys optical laws, while enabling emphasis and control of the optical properties that make a diamond a prized material. The additional pavilion first step side and corner facets are arranged in visual coordination with the brilliant cut crown so that when viewed through the crown table, the first step facet arrangement does not interfere with the crown facet arrangement, but instead mirrors the crown facet arrangement. In this way, the integrity of the stone is maintained and a cohesive stone results. The top points of the four large crown bezel facets are aligned with the pavilion first step facet junction when viewed through the table so that the width of each side of the crown facet arrangement as measured from table to girdle, mirrors the length of the first step facet arrangement on each pavilion side, as measured from girdle to first step facet junction. The crown facets are further aligned with the added triangular corner and side facets of the first pavilion step so that when viewed through the crown table the first pavilion step facet arrangement roughly mirrors the arrangement of the crown facets. This alignment creates visual connection points between the crown and the pavilion of the stone when viewed through the table and further prevents interference between the crown and pavilion facets that would affect the brilliance of the stone and the view into the stone. The alignment further creates a mirroring effect between: the small bezel facets of the crown and the pavilion main corner first step facets, the crown upper girdle facets and the pavilion corner side first step facets and the large crown bezel facets and the pavilion side main first step facets. As a result of the alignment of these facets, the table frames a clean and uninterrupted view of the concentric second and third step facet junctions of the pavilion that work down to the culet without interference of crown or first pavilion step facets when the stone is viewed from above. Two triangular facets added to each pavilion corner create the rounded square shape of the pavilion. The rounded pavilion corners do not create 90° angles.

Moreover, the traditional step cut pavilion has been modified by a deeply cut first pavilion step. This first step makes up one-third of the total pavilion depth. The succeeding second, third and fourth pavilion steps are cut of equal depth and make up the remaining two-thirds of the pavilion depth. The deepness of the elongated first step, cut at high angles relative to said girdle plane, creates a first step that is closer to perpendicular in relation to the table than a conventionally step cut pavilion, thus allowing the succeeding three steps to be worked within the critical angle of the stone. This deeper first step is necessary to prevent the pavilion facets from interfering by crossing with the facets of the brilliant cut crown when the stone is viewed from above. The top points of the crown main bezel facets, adjacent to the table, are aligned with the facet junctions between the first and second step on the pavilion. This alignment becomes a visual and functional connection point between the crown and the pavilion of the diamond. Thus, the deeply cut first step allows a view the succeeding second, third and fourth steps of the pavilion that create the architecture of the stone viewed from above. In a typical step-cut stone the succeeding pavilion facet lines are concealed from view by the facet lines of the first step. The ability to look into the stone to view the facet junctions of the succeeding steps allows a viewer a depth perception not available with conventional brilliant or step cut stones.

In the present invention, the crown angle is cut so as to give sufficient surface area for dispersion and reflection. The first step has been designed to create a visual and cohesive connection between the facet points of the crown and the first step. The deep first step emphasizes contrast in the open steps below and the fire of the brilliant cut crown. This combination of facet shapes, quantity of facets, facet angles, facet lines that are visible when looking through the top of the stone together with the rounded square shape of the girdle and pavilion creates a unique and attractive design with a unique function that does not currently exist in the marketplace.

Stone cuts vary in popularity, and hence in value. The market advantage to this invention is the creation of a unique stone that is immediately recognizable to both the consumer and the professional. This invention contemplates a significant change to existing diamond designs that goes beyond the addition of new facets. By altering, controlling and yet preserving the brilliance and fire of a diamond, the present invention allows the viewer to explore the facets deep in the pavilion of the stone, creating a unique viewing experience. The stone of the present invention commands a thoughtful look from the viewer by first attracting attention and then drawing that attention deeper into the heart of the gemstone.

DETAILED DESCRIPTION OF THE INVENTION

In describing a preferred embodiment of the invention illustrated in the drawings, specific terminology will be employed for clarification. However, the invention is not intended to be limited to the specific terms selected, and each specific term includes all technical equivalents, which operate in a similar manner to accomplish a similar purpose.

In one embodiment of this invention, a mixed-cut gemstone is provided comprising a brilliant cut crown and a modified step cut pavilion. This mixed cut gemstone comprises a girdle, a brilliant cut crown above said girdle, a modified step cut pavilion below said girdle and a culet. The modified step cut pavilion comprises at least two steps, a first step 14 descending from the girdle 10 to the first step facet junction 11 and a second step 15 descending from the first step facet junction to the culet 18. In the preferred embodiment of this invention four pavilion steps are provided.

Ranges for the angles formed by each crown and pavilion facet are provided as are preferred angles. The exact angle employed will depend on the nature of the stone used. Any adjustment of facet angle should be made consistently throughout the stone. The pavilion angle is used to determine the ideal of the stone, which is preferably 57°, however the ideal may range from 55° to 60°. A facet angle is the angle the facet makes with said girdle plane. The main corner first step facets and the main first step facets are then cut at the same angle relative to said girdle plane as the determined pavilion angle. The facet angle of the pavilion side corner facets must be ½° to 1° less than the pavilion angle. The facet angles of the pavilion side first step facets must be 1° to 2° less than the pavilion angle. The facet angle of the main corner second step facets and main second step facets angles are determined by decreasing the pavilion angle by 10°. The facet angle of the main corner third step facets and main third step facets are determined by decreasing the second step facet angles by 10°. The fourth pavilion step facet angle must be a minimum of 30°. This formulaic determination of facet angles provides a blueprint for the ideally cut stone of the present invention that will display the characteristics described above.

The crown angles may be determined using any of the main corner crown facets or the main crown facets. The crown angle ideal is preferably 28°, however the crown angle may be between 26° and 30°. The facet angle of the upper girdle facets must be 2° greater than the crown angle. The facet angle of the star facets must be 1° less than the crown angle. This formulaic representation of the diamond will create a stone that best displays the desired characteristics described above.

Figure 1:
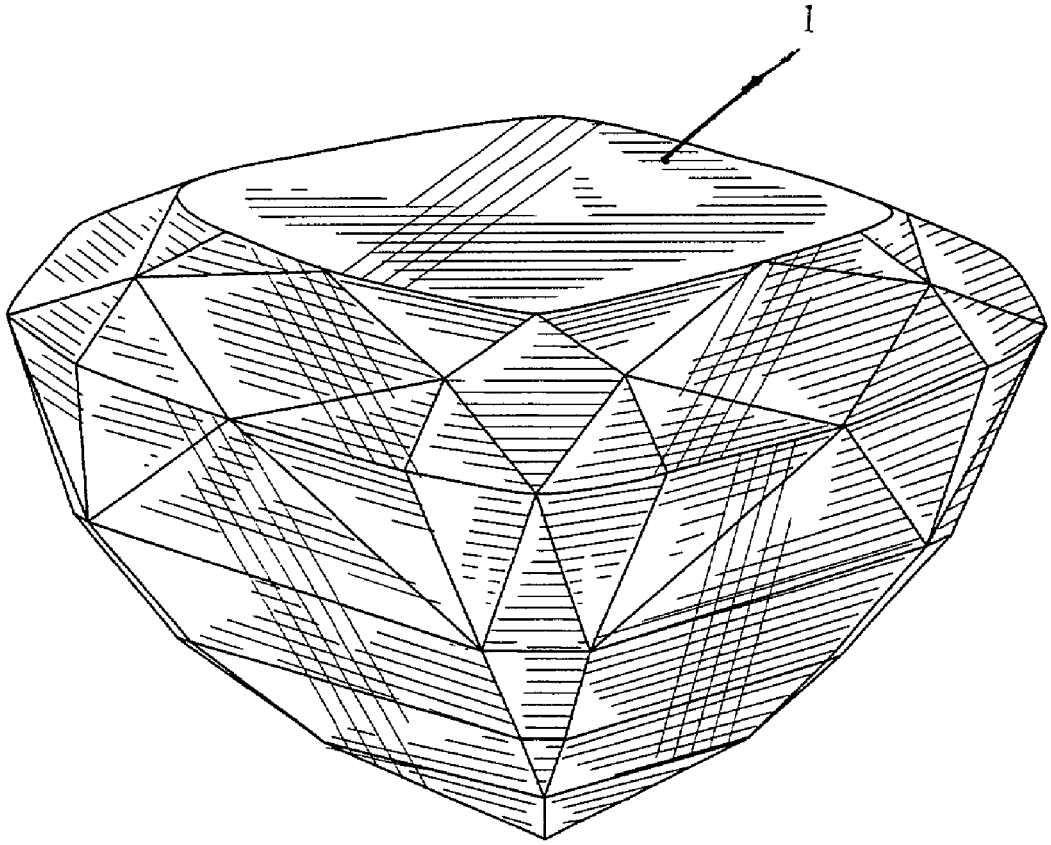
FIG. 1 is a perspective view of the claimed invention.
Figure 2:
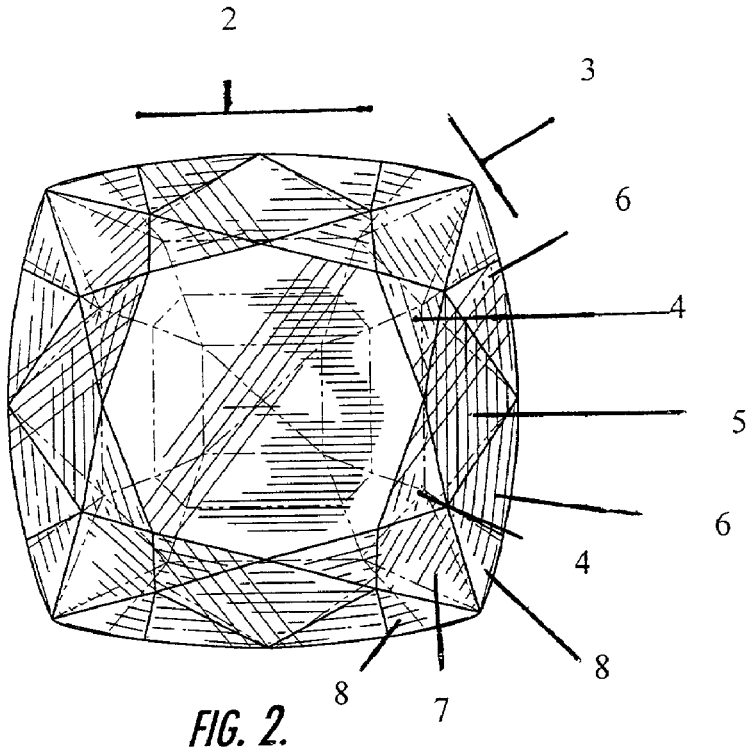
FIG. 2 is a top plan view of the claimed invention.

As seen in FIG. 2, a top plan view of the crown, the crown has a width and a length formed by two pairs of opposing crown sides 2 and four crown corners 3. The crown has a substantially flat, octagonal shaped table 1. Each of the four opposing crown sides comprises five facets including: two star facets 4 located adjacent to the table 1, whose planes intersect with the girdle at between 25° and 29°, and preferably at 27°, one large main crown bezel facet 5 located adjacent to the star facets 4, whose plane intersects with the girdle at between 26° and 30°, and preferably at 28° and two crown side upper girdle facets 6 located adjacent to the main crown bezel facet and the girdle, whose planes intersect with the girdle at between 28° and 32°, and preferably at 30°. Each crown star facet intersects with the girdle at between 1° and 2° less than the intersection of each crown corner bezel facet with the girdle. Each crown corner comprises three facets: two crown corner upper girdle facets 8 located adjacent to said girdle plane, whose planes intersect with the girdle at between 28° and 32°, and preferably at 30° and one crown corner bezel facet 7 located adjacent to crown corner upper girdle facets, whose plane intersects with the girdle at between 26° and 30°, and preferably at 28°. The crown side and corner upper girdle facets always intersect with the girdle at between 1° and 2° degrees greater than the intersection of the crown side and corner bezel facets and the girdle.

The square or rectangular shaped crown preferably has a total of thirty-three crown facets. The configuration of the crown may be defined by the table percentage, a measure of the size of the table relative to the diameter of the girdle. The table percentage of the present invention is in the range of about 63% and 67% of the total crown and preferably 62%. The crown angle between the plane of the girdle break and the table should be in the range of 25°–30°, and preferably be 30°.

Brilliance is not maximized in this invention, but is controlled in order to allow a viewing area into the pavilion of the stone thereby creating a sense of depth. Brilliant cut crowns are typically cut using a crown angle of 34° in order to maximize brilliance and dispersion. In the instant invention, a shallow cut crown angle of 26°–30°, and preferably 28° is used in combination with a relatively large table of 60%–65%, preferably 62%. The crown depth is 9%–11%. This combination of a shallow crown and large table forces the crown facets closer to the girdle thereby allowing an open table area for viewing the internal facet structure of the stone while maintaining a degree of brilliance and dispersion in the crown.

Figure 3:
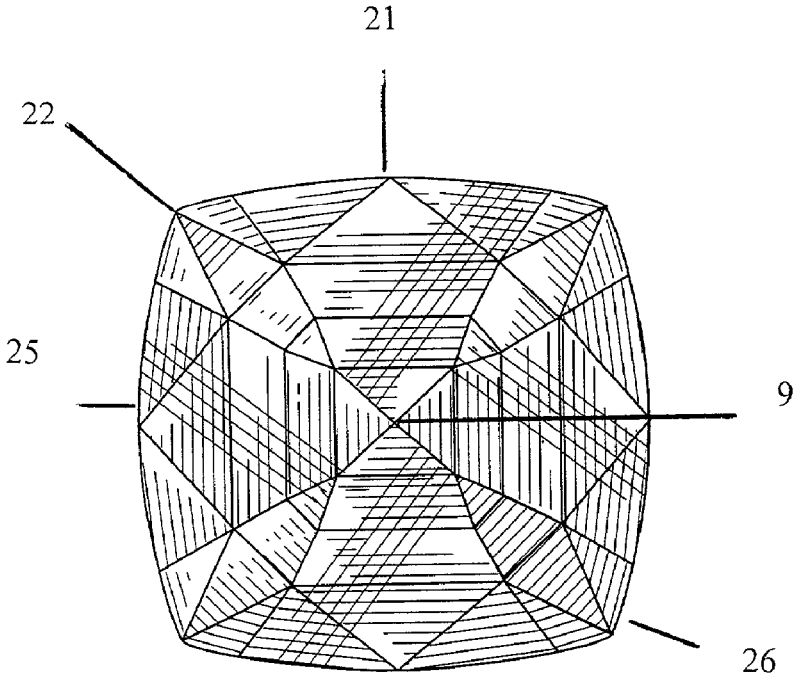
FIG. 3 is a bottom plan view of the claimed invention.
Figure 4:
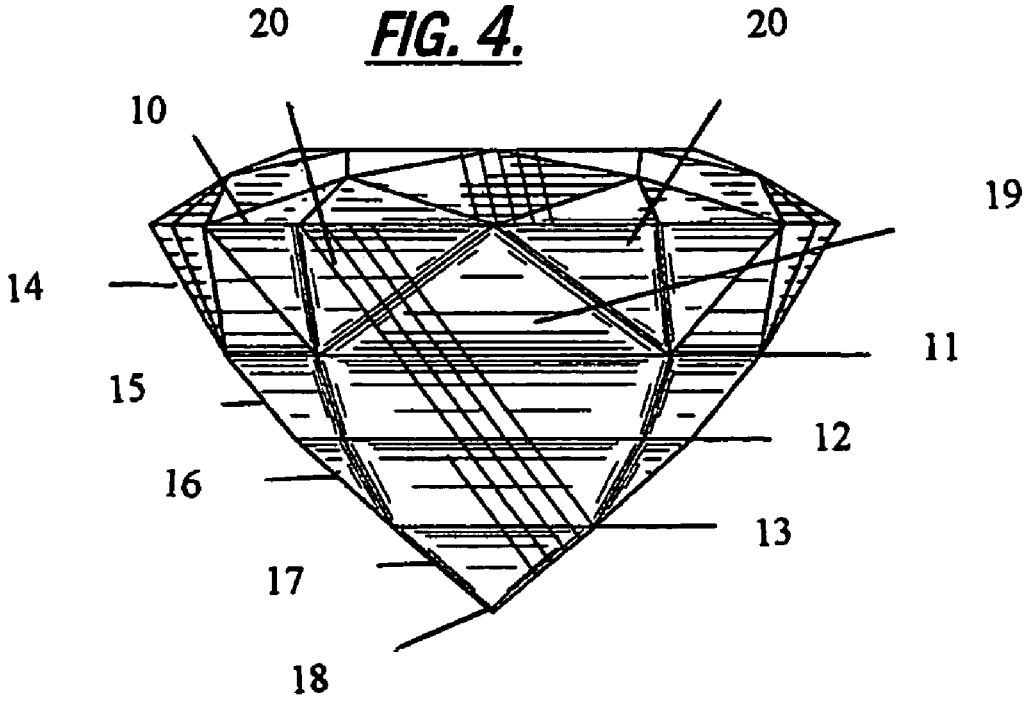
FIG. 4 is a side plan view of the claimed invention.
Figure 5:
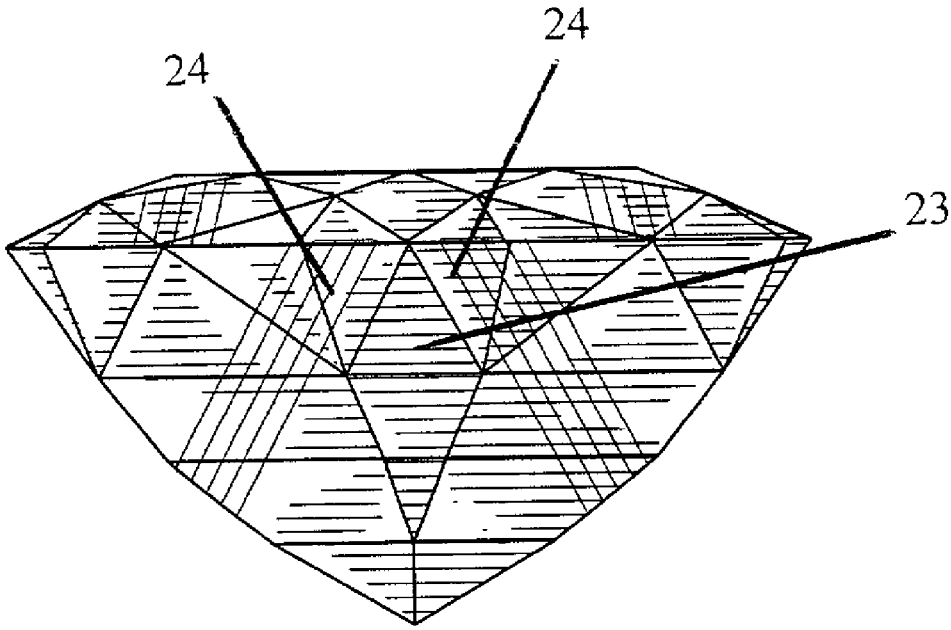
FIG. 5 is a corner plan view of the claimed invention.
Figure 6:
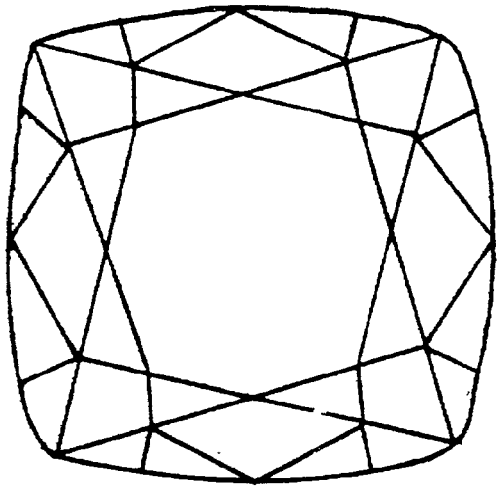
FIG. 6 is a top plan view of the crown of the claimed invention as it appears when severed from the pavilion by said girdle plane.
Figure 7:
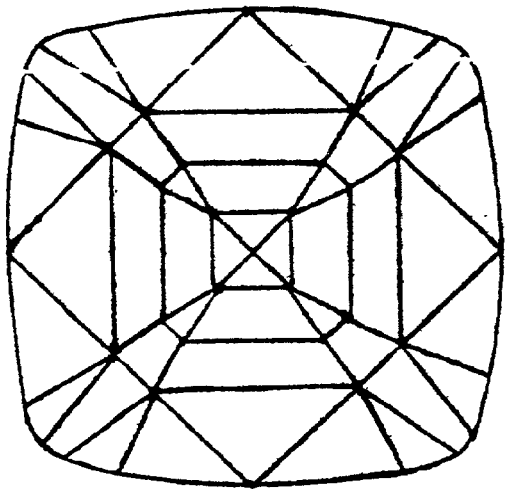
FIG. 7 is a cross sectional view of the pavilion of the preferred embodiment of the claimed invention, having a pointed culet, as it appears when severed from the crown at the girdle plane.

Three pavilion steps typically define a step cut pavilion. In the present invention the conventional step cut pavilion is modified by the addition of a fourth pavilion step. The pavilion as depicted in FIG. 3, a bottom plan view, comprises two pairs of opposing pavilion sides 21 that stretch from the girdle to the culet and four pavilion corners 22 that stretch from the girdle to the culet. The pavilion culminates in a substantially centrally located culet 9. The culet may be formed of a point or a small square facet parallel to the table. The pavilion as shown in FIG. 4, a side plan view, is composed of a first step 14 that descends from the girdle 10 to first step facet junction 11. The facet junction is the line dividing two succeeding facet planes of differing angles. A second pavilion step 15 descends from the first step facet junction to the second step facet junction 12, a third pavilion step 16 descends from the second step facet junction to the third step facet junction 13 and a fourth pavilion step 17 descends from the third step facet junction to the culet. The second and third pavilion steps each contain eight pavilion facets: four pavilion main facets and four pavilion corner facets, cut at angles that work around the critical angle of the pavilion portion, 24.5°. The fourth pavilion step is composed of four triangular facets that culminate in the culet.

In accordance with the present invention, sixteen lower girdle facets are added to the first pavilion step that further modify the conventional step cut pavilion. Each of the four opposing pavilion sides of the first step comprises three triangular facets: one triangular main first step facet 19 and two triangular side first step facets 20. Each pavilion corner is likewise divided into three triangular facets: one large triangular corner main first step facet 23 and two smaller triangular corner side first step facets 24. Thus in the preferred embodiment of this invention the first step comprises a total of twenty-four facets: twelve pavilion corner or main facets and twelve pavilion side lower girdle facets. All angles are defined in relation to the girdle plane.

The pavilion triangular main first step facets have a top point in contact with the girdle, and a pair of diagonally opposite points in contact with the first step facet junctions. The planes of the triangular main first step facets intersect with the girdle plane at between 55° and 60°, and preferably at 57°. The two triangular side first step facets of each pavilion side each have two diagonally opposite points in contact with the girdle and a top point in contact with the first step facet junction. The planes of the two triangular side first step facets intersect with the girdle plane at between 56° and 57°, and preferably at 58°. The angle of the two triangular side first step facets must remain 1°–2° less than the angles at which the corner main first step facets and the main first step facets intersect with the girdle plane. In the most successful method of manufacture of this cut, the larger triangular main first step facet is cut into each side of the first pavilion step at 57° relative to the girdle. The remaining triangular side first step facets are then cut into each side of the first pavilion step at between 56° and 57° relative to the girdle plane.

The four triangular corner main first step facets have a top point that intersects with the girdle and two diagonally opposing side points that intersect with the first step facet junction. These facets are cut at an angle of about 55°–60° relative to the girdle plane, and preferably at 57°. The two smaller triangular corner side first step facets of each pavilion corner each have a pair of diagonally opposing side points that intersect with the girdle and a top point that intersects with the first step facet junction. The planes of the two smaller triangular corner side first step facets intersect with the girdle at between 56° and 57°. The angle of these facets will always be slightly less, by ½°–1°, than the angle of the corner main first step facet and the angle of the main first step facet.

In a further modification of the conventional step cut pavilion, the first step of the pavilion is cut deeper than the succeeding pavilion steps making up one-third of the total pavilion depth. The total pavilion depth, a measurement of girdle to culet as compared to table to culet is 45%–47%. This deep first step is also cut at unusually high angles creating a pavilion outline that is much closer to perpendicular than the conventional step cut. The succeeding steps make up the remaining two-thirds of the pavilion depth and are cut of equal depth. The elongated first step is not an intuitive change to the conventional step cut pavilion structure because it makes it difficult for the cutter to force the succeeding steps to meet the culet while still working within the critical angle in order to preserve the life of the stone. If the pavilion becomes too long overall, light entering the crown will not be reflected back through the crown of the stone, but will escape through the pavilion side, resulting in a dull stone. However, this longer first step is necessary to create a cohesive stone in which the additional facets of the first pavilion steps are aligned with the crown facets such that when viewing the stone from above the pavilion facets do not intersect or interfere with the crown facets. In the preferred embodiment of this invention, four pavilion steps are provided. The succeeding second, third and fourth steps that make up two-thirds of the pavilion depth are cut in equal length in order to accommodate the length of the first step.

The elongated first step allows a view of the succeeding second, third and fourth steps of the pavilion when the stone is viewed from above. In a conventional brilliant cut stone the pavilion facets are completely obscured from view by the crown facets that are cut in a manner to maximize brilliance and dispersion. In a conventional step-cut stone the pavilion facet lines are obscured from view by the facet lines of the first step. The steeper first step of the current invention allows a view of the succeeding pavilion facet lines, thus allowing a view of the architecture of the stone. Moreover, the large table and facet arrangement of the crown forces the facets to the perimeter of the crown creating a viewing space into the stone. The ability to look into the stone to view the architecture of the succeeding steps creates the feeling of a deeper stone. This differs from the typical diamond cut which the facet view is typically limited to the crown facets and obscured by the brilliance and dispersion of those facets.

The second pavilion step 15 comprises eight polygonal shaped, facets, four opposing main second step facets cut at between 45° and 50° and preferably at 47° relative to the girdle plane, and four opposing corner second step facets, cut at an angle of about 45° to 50° relative to the angle of the girdle plane, preferably at 47°. The third step 16 comprises eight facets, four opposing main third step facets cut at between 35°–40°, and preferably 37° and four opposing corner third step facets, cut at around 35° to 40° relative to the angle of the girdle plane, and preferably at 37°. The forth pavilion facet step 17 comprises four triangular shaped adjacent facet sides cut at a minimum of 30° that culminate in the culet. The angle of the fourth step must remain at least 30° in order to prevent the stone from becoming too transparent and losing life or windowing. The repeated pattern of succeeding pavilion steps emphasizes the stone depth when viewed from above. Working within the ranges provided, the facet angles of the first three pavilion steps decrease while working down to the culet by approximately about 10° for each pavilion step.

Forty four steps make up the pavilion of this diamond. A total of seventy seven crown and pavilion facets exist less any culet facet.

The pavilion angle between the plane of the girdle break and the culet should be in the range between 55 and 60°, preferably 57°.

The preferred ratio between the width and the length of the stone ranges from 1:1 to 1:50. Thus the stone may vary from rounded square to rounded rectangular.

The girdle shape is a square shape with rounded corners. The girdle thickness may range from thin to thick, depending on the diamond material used. The girdle may become slightly thicker at the corners.

The total depth of the gemstone is preferably about 63% to 67% with an ideal depth of 65%, as compared to the total width of the stone.

The pavilion angle is in the range between 55° and 60°, and is preferably 57°. The main first step facet and the corner main facet are used to determine the pavilion angle. The pavilion depth is between 45% and 47%.

While only a limited number of embodiments of the invention have been shown and described in detail, there will now be obvious to those skilled in the art many modifications and variations satisfying many or all of the objects of the invention but which do not depart from the spirit thereof as defined by the appended claims. For example, although there has been shown only a square cut stone, the invention contemplates any straight edged polygon stone. Additionally, although a stone with four pavilion steps has been described, the invention contemplates any plurality of steps combined with the unique first step facet structure herein described.

The invention claimed is:

1. A mixed cut gemstone comprising:

a girdle in a girdle plane;

a crown above said girdle;

a pavilion below said girdle; and a culet, said crown having a girdle break, a table break and a table, said table break being cut with triangular shaped facets and said girdle break being cut with triangular and quadrilaterally shaped facets, said pavilion width having a width and a length formed by two pairs of opposing pavilion sides and four pavilion corners, said pavilion including:

a first step adjacent to said girdle and to a first step facet junction, a second step adjacent to said first step facet junction and to a second step facet junction, a third step adjacent to said second step facet junction and to a third step facet junction, and a fourth step adjacent to said third step facet junction and to said culet, wherein each of said first, second, third and fourth steps further comprises a plurality of facets, and wherein said plurality of facets of said first step is greater than said plurality of facets of said second step by at least one facet.

2. The mixed cut gemstone of claim 1, wherein said culet is substantially in the form of a point.

3. The mixed cut gemstone of claim 1, wherein said culet is substantially in the form of a square facet parallel to said table.

4. The mixed cut gemstone of claim 1, wherein said crown has a crown angle between 26° and 30°.

5. The mixed cut gemstone of claim 1, wherein said crown has a crown angle of 28°.

6. The mixed out gemstone of claim 1, wherein said crown has a depth of between 9% and 11%.

7. The mixed cut gemstone of claim 1, wherein said girdle has a width, and wherein said table has a width and a size defined by its width, said table size being between 60% and 65% of the width of the crown at the girdle.

8. The mixed cut gemstone of claim 1, wherein the girdle has a width, and wherein the table has a width and a size defined by its width, said table size being 62% of the width of the crown at the girdle.

9. The mixed cut gemstone of claim 1, wherein said table is octagonal.

10. The mixed cut gemstone of claim 1, wherein said pavilion has a pavilion angle between 55° and 60°.

11. The mixed cut gemstone of claim 1, wherein said pavilion has a pavilion angle of 57°.

12. The mixed cut gemstone of claim 1, wherein said pavilion has a pavilion depth between 45% and 47%.

13. The mixed cut gemstone of claim 1, wherein said pavilion first step comprises one-third of the total depth of said pavilion and wherein said pavilion second, third and fourth steps together comprise two-thirds the total depth of said pavilion.

14. The mixed cut gemstone of claim 13, wherein said pavilion second, third and fourth steps are of equal length.

15. The mixed cut gemstone of claim 1, wherein said first pavilion step comprises more than eight facets.

16. The mixed cut gemstone of claim 1, wherein said first pavilion step comprises twenty-four facets.

17. The mixed cut gemstone of claim 1, wherein each of said first pavilion step opposing pavilion sides and each of said first pavilion step pavilion corners comprises a plurality of facets.

18. The mixed cut gemstone of claim 1, wherein said first pavilion step further comprises:

three facets on each of said pairs of opposing pavilion sides; and three facets of each of said four pavilion corners.

19. The mixed cut gemstone of claim 18, wherein said three facets on each of said pairs of opposing pavilion sides further comprise:

one side main first step facets; and two side first step facets; and wherein said three facets on each of said four pavilion corners comprise:

one main corner first step facet, and two side corner first step facets.

20. The mixed cut gemstone of claim 19, wherein all said pavilion first step side main facets and all said pavilion first step main corner facets fain an angle of between 55° and 60° with said girdle plane.

21. The mixed out gemstone of claim 19, wherein all said pavilion first step side main facets and all said pavilion first step main corner facets form an angle of 57° with said girdle plane.

22. The mixed cut gemstone of claim 19, wherein each of said pavilion side first step facets forms an angle of between 56° and 57° with said girdle plane.

23. The mixed cut gemstone of claim 19, wherein each of said pavilion side first step facets forms an angle with said girdle plane of between 1° and 2° less than the intersection of said main cower first step facets and said main side first step facets with said girdle plane.

24. The mixed cut gemstone of claim 19, wherein each of said side corner first step facets forms an angle with said girdle plane of between ½° and 1° less than the angle formed by each of said main corner first step facets with said girdle plane.

25. The mixed cut gemstone of claim 19, wherein said girdle and said main corner first step facet form a pavilion angle, wherein said pavilion side corner facets angles are equal to the pavilion angle less ½° to 1°, and wherein said pavilion side first step facets are equal to the pavilion angle less 1° to 2°.

26. The mixed cut gemstone of claim 1, wherein each of said pavilion first step facets is triangular.

27. The mixed cut gemstone of claim 1, wherein said crown triangular shaped facets comprise:

eight star facets adjacent to said table;

eight crown side upper girdle facets adjacent to said girdle; and eight crown corner upper girdle facets adjacent to said girdle; and said crown quadrilaterally shaped facets comprise:

four main crown facets; and four main corner crown facets.

28. The mixed cut gemstone of claim 27, wherein each of said crown corner upper girdle facets and each of said crown side upper girdle facets forms an angle of between 28° and 32° with said girdle plane.

29. The mixed cut gemstone of claim 27, wherein each of said crown corner upper girdle facets and each of said crown side upper girdle facets forms an angle of 30° with said girdle plane.

30. The mixed cut gemstone of claim 27, wherein each of said star facets forms an angle of between 25° and 29° with said girdle plane.

31. The mixed cut gemstone of claim 27, wherein each of said star facets forms an angle of 27° with said girdle plane.

32. The mixed cut gemstone of claim 27, wherein each of said main crown facets and each of said main corner crown facets forms an angle of between 26° and 30° with said girdle plane.

33. The mixed cut gemstone of claim 27, wherein each of said main crown facets and each of said main corner crown facets forms an angle of 28° with said girdle plane.

34. The mixed cut gemstone of claim 27, wherein a top point on each of said main crown facets is aligned with said first step facet junction when viewed through said table.

35. The mixed cut gemstone of claim 27, wherein said main crown facets and said girdle form a crown angle, wherein each angle of said upper girdle is equal to the crown angle plus 2°, and wherein each angle of said star facets is equal to the crown angle less 1°.

36. The mixed cut gemstone of claim 1, wherein said second pavilion step and said third pavilion step each comprise four pavilion main side facets and four pavilion corner facets.

37. The mixed cut gemstone of claim 1, wherein said fourth pavilion step comprises four pavilion facets.

38. The mixed cut gemstone of claim 1, wherein the angles formed with said girdle plane of said pavilion main first step, said pavilion second step and said pavilion third step decrease incrementally by 10°.

39. The mixed cut gemstone of claim 1, wherein said pavilion second step and said pavilion third step each comprise:

one facet on each of said pairs of opposing pavilion sides; and one facet on each of said four pavilion corners.

40. The mixed cut gemstone of claim 39, wherein the facets on said second step pairs of opposing pavilion sides and said four pavilion corners each forms an angle of between 45° and 50° with said girdle plane.

41. The mixed cut gemstone of claim 39, wherein the facets on each of said second step pairs of opposing pavilion sides and said four pavilion corners each forms an angle of 47° with said girdle plane.

42. The mixed cut gemstone of claim 39, wherein the facets on each of said third step pairs of opposing pavilion sides and said four pavilion corners each forms an angle of between 35° and 40° with said girdle plane.

43. The mixed cut gemstone of claim 39, wherein the facets on each of said third step pairs of opposing pavilion sides and each of said four pavilion corners each forms an angle of 37° with said girdle plane.

44. The mixed cut gemstone of claim 39, wherein said girdle and said main corner first step facet form a pavilion angle, wherein each of said facets on each of said pairs of said second step opposing pavilion sides has a facet angle equal to the pavilion angle less 10°, and wherein each of said facets on each of said second step four pavilion corners has a facet angle equal to the pavilion angle less 10°.

45. The mixed cut gemstone of claim 39, wherein said girdle and said main corner first step facet form a pavilion angle, wherein each of said facets on each of said pairs of said third step opposing pavilion sides has a facet angle equal to the pavilion angle less 20°, and wherein each of said facets on each of said third step four pavilion corners has a facet angle equal to the pavilion angle less 20°.

46. The mixed cut gemstone of claim 1, wherein said pavilion fourth step forms a minimum angle of 30° with said girdle plane.

47. The mixed cut gemstone of claim 1, wherein the gemstone has a total depth of about 63% to 67% of the width of said girdle.

48. The mixed cut gemstone of claim 1, wherein the gemstone has a total depth of 65% of the width of the girdle.

49. The mixed cut gemstone of claim 1, wherein said fourth step forms at least a 30° angle with said girdle.

50. A mixed cut gemstone comprising:

a girdle;

a crown above said girdle, said crown having a girdle break, a table break and a table, said table break being cut with triangular shaped facets, said girdle break being cut with triangular and quadrilaterally shaped facets, and a pavilion below said girdle, said pavilion having a width and a length formed by two pairs of opposing pavilion sides and four pavilion corners, said pavilion having at least two steps that include:

a first of said at least two steps being adjacent to said girdle and to a first step facet junction, and a second or more of said at least two steps being adjacent to said first step facet junction and to a culet, wherein each step of said at least two steps having a plurality of facets, and wherein said plurality of facets of said first step is greater than said plurality of facets of said second or more of said at least two steps by at least one facet.

51. The mixed cut gemstone of claim 50, wherein said pavilion first step comprises one-third of the total depth of said pavilion, and wherein said pavilion steps between said first step and said culet together make up two-thirds of the total depth of said pavilion.

52. The mixed cut gemstone of claim 51, wherein said pavilion steps excluding said first pavilion step are of equal depth.

53. A mixed cut gemstone comprising:

a brilliant cut crown; and a step cut pavilion, said step out pavilion having at least two steps, said first step being closest to the crown and having exclusively triangular shaped facets.

54. A diamond comprising:

a girdle cushioned in shape;

a crown being positioned adjacent the girdle; and a step cut pavilion being positioned adjacent the girdle opposite the crown, said pavilion having a first step and a second step, the first step being adjacent the girdle, the first step having more facets than the second step, said first step having exclusively triangular shaped facets.

55. A diamond comprising:

a girdle;

a crown being positioned adjacent the girdle;

a step cut pavilion being positioned adjacent the girdle opposite the crown, said pavilion having three or more steps, wherein the three or more steps have a first step being adjacent the girdle, the first step having facets and having a depth greater than the remaining steps, the first step including at least one triangular shaped facet, wherein the remaining steps have facets and the same depth, and wherein the first step has more facets than either one of the remaining steps.

* * * * *